United States Patent [19]

Amano et al.

[11] Patent Number: 4,908,080

[45] Date of Patent: Mar. 13, 1990

[54] WATER-IN-OIL TYPE EMULSION EXPLOSIVE WITH CHELATING AGENT

[75] Inventors: Tomoyuki Amano; Koichi Kurokawa; Koji Edamura, all of Chita, Japan

[73] Assignee: Nippon Oil and Fats, Co., Ltd., Tokyo, Japan

[21] Appl. No.: 379,687

[22] Filed: Jul. 13, 1989

Related U.S. Application Data

[63] Continuation of Ser. No. 232,099, Aug. 15, 1988, abandoned.

[30] Foreign Application Priority Data

Aug. 25, 1987 [JP] Japan ..... 62-209126

[51] Int. Cl.[4] ..... C06B 45/00

[52] U.S. Cl. ..... 149/2; 149/36; 149/46; 149/47; 149/56; 149/57; 149/61; 149/67; 149/76; 149/58; 149/80; 149/83; 149/92; 149/105

[58] Field of Search ..... 149/2, 36, 46, 47, 56, 149/57, 61, 67, 76, 78, 80, 83, 92, 105

[56] References Cited

U.S. PATENT DOCUMENTS

| | | | |
|---|---|---|---|
| 4,371,408 | 2/1983 | Fillman | 149/2 |
| 4,383,873 | 5/1983 | Wade et al. | 149/2 |
| 4,394,198 | 7/1983 | Takeuchi et al. | 149/2 |
| 4,525,225 | 6/1985 | Cechanski | 149/2 |
| 4,543,136 | 9/1985 | Edamura et al. | 149/2 |
| 4,554,032 | 11/1985 | Hattori et al. | 149/2 |
| 4,710,248 | 12/1987 | Yatis et al. | 149/2 |
| 4,732,626 | 3/1988 | Edamura et al. | 149/2 |

FOREIGN PATENT DOCUMENTS

| | | |
|---|---|---|
| 1360081 | 4/1985 | European Pat. Off. . |
| 0142271 | 5/1985 | European Pat. Off. . |
| 0252625 | 1/1988 | European Pat. Off. . |
| 2138415 | 10/1984 | United Kingdom . |
| 2194527 | 3/1988 | United Kingdom . |

OTHER PUBLICATIONS

Chemical Abstracts, vol. 101, No. 6, p. 125, No. 40658f (Aug. 1984).

*Primary Examiner*—Stephen J. Lechert, Jr.
*Attorney, Agent, or Firm*—Arnold, White & Durkee

[57] ABSTRACT

Thermostability, age stability, and ignition property at low temperatures of a W/O type emulsion explosive are remarkably improved by incorporating a chelating agent in the W/O type emulsion explosive.

3 Claims, No Drawings

WATER-IN-OIL TYPE EMULSION EXPLOSIVE WITH CHELATING AGENT

This is a continuation of application Ser. No. 07/232,099 filed Aug. 15, 1988, now abandoned.

BACKGROUND OF THE INVENTION

1. Field of the Invention

The prevent invention relates to a water in oil type emulsion explosive, particularly a water in oil type emulsion explosive composed of a continuous phase consisting of a carbonaceous fuel, a dispersive phase consisting of an aqueous solution of an inorganic oxidative salt, an emulsifier, a foam retainer, and an auxiliary sensitizer.

2. Related Art Statement

Recently, many studies on water in oil type emulsion explosive have been reported. Among such reports, there are known water in oil type (to be referred to as "W/O type", hereinafter) emulsion explosive not containing an explodent sensitizer such as trinitrotoluene or trimethylenetrinitramine, etc. and containing an auxiliary sensitizer such as monomethylamine nitrate or hydrazine nitrate, etc. and having an improved detonability of a blasting cap and an improved sympathetic detonation property, as disclosed by Japanese Patent Application Laid-open Nos. 60-51,685 and 60-90,887.

Though the W/O type emulsion explosive disclosed by the above Official gazette do not contain an explodent sensitizer, they contain an auxiliary sensitizer. Therefore, in case when they are used for blasting rocks of a high temperature or in an atmosphere of a high temperature caused by a pressurized state of a blasting hole, the explosives are liable to be decomposed. Such decomposition at the time of blasting is likely to lead an accidental detonation, and has a risk of incurring a gas explosion if a combustible gas is present in the environmental atmosphere of drifts of coal mines or the like. Hence, the W/O type emulsion explosive must be improved.

SUMMARY OF THE INVENTION

Therefore, an object of the present invention is to provide a W/O type emulsion explosive containing an auxiliary sensitizer, which does not decompose even at an easily decomposable state as mentioned above, and is stable for a long period of time in a usual condition.

Another object of the present invention is to provide a W/O type emulsion explosive of remarkably improved thermostability and age stability.

Now, the above objects can be achieved by the present invention.

The present invention is a W/O type emulsion explosive composed of a continuous phase consisting of a carbonaceous fuel, a dispersive phase consisting of am aqueous solution of an inorganic oxidative salt, an emulsifier, a foam retainer, and an auxiliary sensitizer, comprising further a chelating agent, said auxiliary sensitizer being a nitric acid salt of a compound of the general formula $$X—NH_2$$

wherein X represents $CH_3$, $CONH_2$, $CH_2CH_2NH_2$, $CH_2CH_2OH$, $NH_2$ or $H_2NCNH$ group.

The carbonaceous fuel which forms the continuous phase in the W/O type emulsion explosive of the present invention includes all the carbonaceous fuels that are conventionally used in producing the prior W/O type emulsion explosive. Illustrative examples thereof are hydrocarbons, such as paraffin series hydrocarbons, olefin series hydrocarbons, naphthene series hydrocarbons, aromatic hydrocarbons, saturated or unsaturated hydrocarbons, petroleum purified mineral oils, lubricants, and liquid paraffin, etc.; hydrocarbon derivatives, such as nitrohydrocarbons, etc.; derivatives of fuel oils and/or petroleum, such as unpurified or purified microcrystallinewax, paraffinwax, etc.; mineral waxes, such as montan wax, etc.; animal waxes, such as whale wax, etc.; insect waxes, such as bees wax, etc.; and other waxes. These are used alone or in admixture. Preferable carbonaceous fuels from the aspect of age stability are microcrystalline wax and petrolactam, particularly microcrystalline wax.

The carbonaceous fuel may also include a polymer of low molecular hydrocarbons, such as petroleum resin, low molecular polyethylene, or low molecular polypropylene, etc.

These carbonaceous fuel is usually used in an amount of 1–10 wt % in the emulsion explosive.

The aqueous solution of the inorganic oxidative salt, which constitutes the dispersive phase of the W/O type emulsion explosive of the present invention, includes all the aqueous solutions of the inorganic oxidative salt that are conventionally used in producing the prior W/O type emulsion explosive. As the inorganic oxidative salt, use is made of, for example, ammonium nitrate; nitrates of alkali metal or alkaline earth metal, such as sodium nitrate, or calcium nitrate, etc.; and inorganic perchlorates, such as ammonium perchlorate, orsodium perchlorate, etc. Usually, ammonium nitrate is used alone or in admixture with other inorganic oxidative salt.

The inorganic oxidative salt is generally used in an amount of 5–90 wt %, usually 40–80 wt %, in the aqueous solution thereof. The aqueous solution of the inorganic oxidative salt is used in an amount of 3–30 wt %, preferably 5–25 wt %, in the emulsion explosive.

The emulsifier used in the present invention includes all the emulsifiers that are conventionally used in producing the prior W/O type emulsion explosive. For example, use is made of fatty acid esters of sorbitan, such as sorbitan monolaurate, sorbitan monooleate, sorbitan monopalmitate, sorbitan monostearate, sorbitan sesquioleate, sorbitan dioleate, or sorbitan trioleate, etc.; mono- or di-glycerides of fatty acid, such as monoglyceride of stearic acid, etc.; fatty acid esters of polyoxyethylenesorbitan; oxazoline derivatives; imidazoline derivatives; phosphoric acid esters; alkali metal salts or alkaline earth metal salts of fatty acids; or primary, secondary or tertiary amine salts, etc. These are used alone or in admixture of at least two. Among these emulsifiers, fatty acid esters of sorbitan are preferable.

The emulsifier is used in an amount of 0.1–10 wt %, preferably 1–5 wt %, in the emulsion explosive.

The foam retainer used in the present invention includes all the foam retainers that are conventionally used or proposed in producing the prior W/O type emulsion explosive. For example, various minute hollow spheric bodies, and foamed bodies containing a plurality of foams can be used. Illustrative examples of such minute hollow spheric bodies are inorganic minute hollow spheric bodies obtained from glass, alumina, shale, sirasu (Japanese volcano ash), silicon sand, volcanic rock, sodium silicate, borax, pearl stone or obsidian, etc.; carbonaceous minute hollow spheric bodies obtained from pitch or coal, etc.; and synthetic resin series minute spheric bodies obtained from phenol resin, polyvinylidenechloride, epoxy resin or urea resin, etc. Illustrative examples of such foamed bodies containing a plurality of foams are particles of foamed synthetic high molecular substances or particulates obtained by grinding such foamed synthetic high molecular substances. The foamed synthetic high molecular substances are prepared by incorporating foams into synthetic high molecular materials, e.g., polymers, copolymers, modified polymers, blend polymers of olefin, such as ethylene or propylene, etc., vinylidene chloride, vinyl alcohol, vinyl acetate, acrylic acid, acrylic acid ester, methacrylic acid, or methacrylic acid ester, etc.; polyurethanes, polyesters, polyamides, urea resins, epoxy resins, phenol resins, or the like, by various means, such as mechanical foaming, chemical foaming, microcapsulation, or incorporation of easily volatile matter. Preferably, particles of preliminarily foamed synthetic high molecular substances of polystyrene, polyurethane, polyethylene or polypropylene, etc. are used, viewed from availability and economical cost.

The foam retainer is used alone or in admixture. The selection of the foam retainer and the mixing recipe of the foam retainers are properly selected depending on the use of the W/O type emulsion explosive. If the explosive is to be used in a use field of thinking much of the dead pressure property of the explosive, the foam retainer is used advantageously in the explosive. The foam retainer is usually used in an amount of adjusting the apparent specific gravity or bulk density of the W/O type emulsion explosive to 0.80–1.35.

In the present invention, the term "auxiliary sensitizer" is used to differentiate it from explodent sensitizer, such as trinitrotoluene, trimethylenetrinitramine, or the like explosives. The auxiliary sensitizer is the nitrate of the compound of the formula $$X—NH_2$$

wherein X represents $CH_3CONH_2$, $CH_2CH_2NH_2$, $CH_2CH_2OH$, $NH_2$ or $H_2NCNH$ group. Illustrative examples thereof are monomethylamine nitrate, hydrazine nitrate, ethylenediamine nitrate, ethanolamine nitrate, guanidine nitrate and urea nitrate. These specific auxiliary sensitizer is used alone or in admixture. The auxiliary sensitizers may also include a metal powder, such as aluminum powder, in addition to the auxiliary sensitizer.

The auxiliary sensitizer is used in an amount of 0.5–50 wt %, preferably 1–40 wt %, in the W/O type emulsion explosive. If the amount is too high, the production of the emulsion explosive becomes hazardous and disadvantageous economically.

The chelating agent which is simultaneously used with the auxiliary sensitizer is exemplified as tartaric acid, oxalic acid, ethylenediaminetetraacetic acid; alkali metal salts or alkaline earth metal salts of these acids; komplexanes, such as nitrilotriacetic acid or alkali metal salts of the acid, etc.; hydroxycarboxylic acids, such as thioglycolic acid, thiols of alkali metal salts, etc. of the acid, sulfosalicyclic acid, or alkali metal salts of the acid, etc.; amines, such as triethanolamine, ethylenediamine, or triethylenetetramine, etc.; β-diketone, such as acetylacetone; ascorbic acid, alkalimetal salts thereof, or dihydroxyethylglycine; thiourea; diethyldithiocarbamine; diaminobenzene; 2,3-dimercapto propanol; o-phenanthoroline; pyrocatechol-3,5-disulfonate; etc. Preferably, acetic acid, tartaric acid, citric acid, oxalic acid, ethylenediaminetetraacetic acid, alkalimetal salts or alkaline earth metal salts of these acids, nitrilotriacetic acid, thioglycolic acid, ascorbic acid, sulfosalicyclic acid, alkalimetal salts of these acids, acetylacetone, or triethanolamine, is used.

The chelating agent is used alone or in admixture. The chelating agent is used in an amount of 0.1–10 wt % relative to the amount of the auxiliary sensitizer, depending on the type and the mixing amount of the auxiliary sensitizer. If the amount of the chelating agent is less than 0.1 wt %, the function of the chelating agent of preventing the decomposition of the W/O type emulsion explosive is small, while, if it exceeds 10 wt %, the function of the chelating agent is not improved and the explosion property of the W/O type emulsion explosive is adversely influenced.

The W/O type emulsion explosive of the present invention may also contain an emulsion stabilizer, such as a heretofore known metallic salt of a higher fatty acid, e.g., zinc stearate, zinc myristate, aluminum stearate, or the like.

Further, the W/O type emulsion explosive may also contain a publicly known reducer or cooling agent, such as sodium chloride, potassium chloride, or the like, for the use in coal mines. In such case, the other components are determined, considering the explosion rate and the post gases, etc.

The W/O type emulsion explosive of the present invention can be produced, for example, as follows.

The inorganic oxidative salt, the auxiliary sensitizer and the chelating agent are dissolved in warm water of about 60°–100° C., to prepare an aqueous solution of the inorganic oxidative salt, etc. Meanwhile, the carbonaceous fuel, and the emulsifier are melt mixed at a liquidifying temperature of generally 70°–90° C., to obtain a combustible mixture.

Then, the aqueous solution of the inorganic oxidative salt, etc., and the combustible mixture are mixed at 60°–90° C. under agitation of about 600–6,000 rpm, to obtain a W/O type emulsion. Subsequently, the foam retainer, and the W/O type emulsion are mixed in a vertical blender at about 30 rpm, to obtain a W/O type emulsion explosive. In the above procedures, the auxiliary sensitizer and the chelating agent may be omitted in preparing the aqueous solution of the inorganic oxidative salt, and they may be added directly in preparing the W/O type emulsion prior to the production of the W/O type emulsion explosive.

The W/O type emulsion explosive of the present invention is stable even at high temperatures by the function of the chelating agent, even though it contains a specific auxiliary sensitizer. Also, it can ignite well at low temperatures after held at high temperatures.

DESCRIPTION OF THE PREFERRED EMBODIMENTS

Hereinafter, the present invention will be explained in more detail with reference to examples, which, however, should not be construed by any means as limitations of the present invention. In the examples, all parts are represented by weight basis.

EXAMPLE 1

W/O type emulsion explosive of the compositions as shown in the following Table 1 are produced in the following way.

73.1 parts of ammonium nitrate, 4.0 parts of hydrazine nitrate, and 5.6 parts of sodium nitrate, are added to 11.2 parts of water. The mixture is added with 0.3 part of zinc stearate as the emulsion stabilizer, and 0.1 part of sodium citrate as the chelating agent. The admixture is completely dissolved at 90° C. to obtain an aqueous solution of the inorganic oxidative slat, etc. In the meantime, 3.2 parts of microcrystalline wax (produced by Mobile Petroleum Co. and sold under the trade name of "Waxrex 602") as the carbonaceous fuel, and 1.6 parts of sorbitan monooleate as the emulsifier, are dissolved at 90° C., to obtain a combustible mixture. The combustible mixture is added slowly with 94.3 parts of the above aqueous solution of the inorganic oxidative slat, at 90° C. under agitation of 650 rpm, to obtain 99.1 parts of a W/O type emulsion. The W/O type emulsion is added with 0.9 part of prefoamed particles of foamed styrol (produced by Mitsubishi Yuka Badische K.K.) as the foam retainer, mixed and blended at 60°-80° C. Each 100 g of the blended mixture is weighed out, shaped into a column of a diameter of 25 mm, and wrapped in a laminated paper. Thus obtained wrapped W/O type emulsion explosive are tested on the following tests; namely, (a) measurement of apparent specific gravity after 1 day of the production, (b) age stability test of ignition sensitivity, wherein the wrapped explosive is subjected to a storage test under forced deterioration consisting of repetition of a temperature cycle of holding the wrapped explosive at −40° C. for 2 hours and then at +30° C. for 22 hours, and then to an ignition test at −15° C. using a No. 6 detonator, in order to determine a number of the temperature cycles that can ignite the explosive fully, (c) test of ignition sensitivity at low temperatures, wherein the wrapped explosive is held at 50° C. for 72 hours, then left under storage at an ambient temperature (0°-30° C.) for 1 year, and ignited at a low temperature, in order to determine the lowest value of such low temperature that can ignite the explosive, and (d) stability of the W/O type emulsion, wherein the wrapped explosive is held at 50° C. for 15 days, then left at 20° C. for 1 day, and measured on its breakage voltage after held at an isothermal and isohumid condition of a temperature of 20°±2° C. and a humidity of 60-65% for 30 minutes by means of a device for measuring a breakage voltage at a discharge gap of 3 mm. The results are shown also in Table 1.

EXAMPLE 2-10

The procedures of Example 1 are repeated using the mixing recipes of the components as shown in Table 1, to obtain respective W/O type emulsion explosive corresponding to the mixing recipes. Each W/O type emulsion explosive is tested on the same items as in Example 1. The results are shown in Table 1.

COMPARATIVE EXAMPLES 1-5

The procedures of Example 1 are repeated using the mixing recipes of the components as shown in Table 1, to obtain respective W/O type emulsion explosive corresponding to the mixing recipes. Each W/O type emulsion explosive is tested on the same items as in Example 1. The results are shown in Table 1.

TABLE 1(a)

(wt %)

| | Example | | | | | | | | | | Comparative Example | | | | |
|---|---|---|---|---|---|---|---|---|---|---|---|---|---|---|---|
| | 1 | 2 | 3 | 4 | 5 | 6 | 7 | 8 | 9 | 10 | 1 | 2 | 3 | 4 | 5 |
| Aqueous solution of inorganic oxidative salt | | | | | | | | | | | | | | | |
| Ammonium nitrate | 73.1 | 75.3 | 69.0 | 71.0 | 52.3 | 47.1 | 66.3 | — | 65.1 | 72.0 | 73.1 | 69.0 | 52.3 | 66.3 | — |
| Sodium nitrate | 5.6 | 5.2 | 9.2 | 9.2 | 4.2 | 1.2 | — | 38.3 | 4.2 | — | 5.6 | 9.2 | 4.2 | — | 38.3 |
| Calcium nitrate | — | — | — | — | — | — | 4.2 | 3.7 | 1.0 | — | — | — | — | 4.2 | 3.7 |
| Water | 11.2 | 9.5 | 9.1 | 9.1 | 12.0 | 12.0 | 12.0 | 3.0 | 10.2 | 12.0 | 11.2 | 9.1 | 12.0 | 12.0 | 3.0 |
| Auxiliary sensitizer | | | | | | | | | | | | | | | |
| Monomethylamine nitrate | — | 1.3 | — | — | — | — | — | — | 5.0 | 2.4 | — | — | — | — | — |
| Hydrazine nitrate | 4.0 | 2.0 | — | — | 20.0 | — | — | 40.0 | — | 4.0 | 4.0 | — | 20.0 | — | 40.0 |
| Ethylenediamine nitrate | — | — | 3.0 | — | — | 30.0 | 5.0 | 5.0 | — | — | — | 3.0 | — | 5.0 | 5.0 |
| Ethanolamine nitrate | — | — | — | 4.0 | — | — | 5.0 | — | — | — | — | — | — | 5.0 | — |
| Guanizine nitrate | — | — | — | — | — | — | — | — | 5.0 | — | — | — | — | — | — |
| Aluminum powder | — | — | — | 1.0 | — | — | — | — | — | — | — | — | — | — | — |

TABLE 1(b)

(wt %)

| | Example | | | | | | | | | | Comparative Example | | | | |
|---|---|---|---|---|---|---|---|---|---|---|---|---|---|---|---|
| | 1 | 2 | 3 | 3 | 5 | 6 | 7 | 8 | 9 | 10 | 1 | 2 | 3 | 4 | 5 |
| Emulsifier | | | | | | | | | | | | | | | |
| Sorbitan monooleate | 1.6 | 1.2 | 1.6 | — | 1.5 | — | 1.5 | — | 1.0 | 1.5 | 1.6 | 1.6 | 1.5 | 1.5 | — |
| Stearic acid monoglyceride | — | 0.5 | — | 1.6 | — | 1.5 | — | 1.5 | 0.7 | — | — | — | — | — | 1.5 |
| Carbonaceous fuel | | | | | | | | | | | | | | | |
| No. 2 light oil | — | — | 1.0 | — | — | — | — | — | 1.0 | — | — | 1.0 | — | — | — |
| 1 115° paraffin | — | — | 2.2 | — | — | — | — | — | 2.4 | — | — | 2.2 | — | — | — |
| 2 Waxrex 602 | 3.2 | 3.4 | — | — | — | — | 3.0 | 1.5 | — | 2.9 | 3.2 | — | — | 3.0 | 1.5 |
| 3 Hi-Mic 2045 | — | — | — | — | 3.0 | 3.0 | — | — | — | — | — | — | 3.0 | — | — |
| 4 Microwax 160 | — | — | — | 3.2 | — | — | — | — | — | — | — | — | — | — | — |
| Foam retainer | | | | | | | | | | | | | | | |
| 1 GMB (Q-cel #500) | — | — | — | — | 5.0 | — | 2.0 | 3.0 | 4.0 | 4.0 | — | — | 5.0 | 2.0 | 3.0 |
| 2 SMB (SPW-7) | — | — | 4.85 | — | — | 3.0 | — | 2.0 | — | — | — | 4.85 | — | — | 2.0 |
| 3 RMB (Expancel DE) | — | — | — | 0.85 | — | — | — | — | — | — | — | — | — | — | |
| 4 Foamed styrol | 0.9 | 1.15 | — | — | — | 0.2 | 0.5 | — | 0.3 | — | 0.9 | — | — | 0.5 | — |
| Emulsion stabilizer | | | | | | | | | | | | | | | |
| Zinc stearate | 0.3 | 0.7 | — | — | — | — | — | — | — | 0.8 | 0.3 | — | — | — | — |

TABLE 1(c)

(wt %)

| | | Example | | | | | | | | | | Comparative Example | | | | |
|---|---|---|---|---|---|---|---|---|---|---|---|---|---|---|---|---|
| | | 1 | 2 | 3 | 4 | 5 | 6 | 7 | 8 | 9 | 10 | 1 | 2 | 3 | 4 | 5 |
| Reducer Chelating agent | Sodium chloride | — | — | — | — | — | — | — | — | — | 0.8 | — | — | — | — | — |
| | Sodium citrate | 0.1 | — | — | — | — | — | — | — | — | — | — | — | — | — | |
| | Tartaric acid | — | 0.05 | — | — | — | — | — | — | — | — | — | — | — | — | — |
| | Potassium acetate | — | — | 0.05 | — | — | — | — | — | — | — | — | — | — | — | — |
| | Calcium oxalate | — | — | — | 0.05 | — | — | — | — | — | — | — | — | — | — | — |
| | Sodium ethylene-diaminetetra-acetate | — | — | — | — | 2.0 | 1.0 | — | — | — | 0.1 | — | — | — | — | — |
| | Nitrilotriacetic acid | — | — | — | — | — | — | 0.5 | — | — | — | — | — | — | — | — |
| | Acetylacetone | — | — | — | — | — | — | — | 2.0 | — | — | — | — | — | — | — |
| | Triethanolamine | — | — | — | — | — | — | — | — | 0.05 | 0.1 | — | — | — | — | — |
| | Sulfosalicylic acid | — | — | — | — | — | — | — | — | 0.05 | — | — | — | — | — | — |
| | Sodium thioglycolate | — | — | — | — | — | — | — | — | — | — | — | — | — | — | — |
| | Ascorbic acid | — | — | — | — | — | 1.0 | — | — | — | — | — | — | — | — | — |

TABLE 1(d)

(wt %)

| | Example | | | | | | | | | | Comparative Example | | | | |
|---|---|---|---|---|---|---|---|---|---|---|---|---|---|---|---|
| | 1 | 2 | 3 | 4 | 5 | 6 | 7 | 8 | 9 | 10 | 1 | 2 | 3 | 4 | 5 |
| Test results | | | | | | | | | | | | | | | |
| (a) Apparent specific gravity (g/cc) | 1.14 | 1.06 | 1.10 | 1.10 | 1.09 | 1.14 | 1.12 | 1.09 | 1.06 | 1.14 | 1.14 | 1.10 | 1.09 | 1.12 | 1.09 |
| (b) Temperature cycle in age stability test of ignition sensitivity (number) | 14 | 11 | 9 | 11 | 14 | 12 | 12 | 12 | 9 | 10 | 7 | 7 | 6 | 5 | 5 |
| (c) Ignition sensitivity at low temperatures (after 12 months, °C.) | −25 | −20 | −15 | −20 | −25 | −20 | −20 | −20 | −15 | −20 | −10 | −15 | −15 | −10 | −10 |
| (d) Breakage voltage (v) | 890 | 650 | 540 | 790 | 920 | 790 | 850 | 740 | 600 | 550 | 440 | 360 | 280 | 350 | 210 |

In Table 1, the carbonaceous fuels represent the following:
1 115° paraffin - paraffin wax (produces by Nippon Seiroo K.K.)
2 Waxrex 602 - microcrystalline wax (produced by Mobile Petroleum K.K.)
In Table 1, the foam retainers represent the followings:
1 GMB (Q-cel #500) - micro hollow glass sperical body (produced by the P.Q. K.K.)
2 SMB (SPW-7) - micro hollow sirasu body (produced by Kushiro Sekitan Kanryu K.K.)
3 RMB (Expancel DE) - polyvinylidenechloride series resin sphere (produced by Kemanorde Plastic K.K.)
4 Prefoamed particles of foamed styrol - prefoamed particles of beads of a size of 0.2 mm or less among the foamed styrol beads produced by Mitsubishi Yuka Badische K.K. (apparent specific gravity 0.3, average particle diameter 0.6 mm)

As clearly seen from the comparison of Examples and Comparative Examples shown in Table 1, the W/O type emulsion explosive of the present invention (Examples 1–10) containing the chelating agent in addition to the auxiliary sensitizer exhibit less destruction at high temperatures, excellent age stability, and splendid ignition property at low temperatures, as compared to the prior W/O type emulsion explosive (Comparative Examples 1–5) containing the auxiliary sensitizer without containing the chelating agent.

Although the present invention has been explained with specific examples and numerical values, it is of course apparent to those skilled in the art that various changes and modifications thereof are possible without departing the broad spirit and aspect of the present invention as defined in the appended claims.

What is claimed is:

1. A water in oil type emulsion explosive composed of a continuous phase consisting of a carbonaceous fuel, a dispersive phase consisting of an aqueous solution of an inorganic oxidative salt, an emulsifier, an auxiliary sensitizer, and a foam retainer, comprising further at least one chelating agent selected from the group consisting of tartaric acid, oxalic acid, ethylenediaminetetraacetic acid, and alkali metal salts and alkaline earth metal salts thereof; nitrilotriacetic acid, thioglycolic acid, ascorbic acid, sulfosalicyclic acid, and alkali metal salts thereof; triethanolamine, ethylenediamine, triethylenetetramine, acetylacetone, dihydroxyethylglycine, thiourea, diethyldithiocarbamine, diaminobenzene, 2,3-dimercapto propanol, o-phenanthoroline, and pyrocatechol-3,5-disulfonate; in an amount of 0.1–10 wt % relative to the amount of the auxiliary sensitizer, said auxiliary sensitizer being a nitric acid salt of a compound of the general formula $$X—NH_2$$

wherein X represents $CH_3CONH_2$, $CH_2CH_2NH_2$, $CH_2CH_2OH$, $NH_2$ or $H_2NCNH$ and in an amount of 0.5–50 wt % in the emulsion.

2. A water in oil type emulsion explosive as defined in claim 1, wherein the chelating agent is at least one or two selected from the group consisting of tartaric acid, oxalic acid, ethylenediaminetetraacetic acid, and alkali metal salts and alkaline earth metal salts thereof; nitrilotriacetic acid, thioglyolic acid, sulfosalicyclic acid, and alkali metal salts thereof; acetylacetone, and triethanolamine.

3. A water in oil type emulsion explosive as defined in claim 1, wherein the amount of the auxiliary sensitizer is 1–40 wt % in the emulsion.

* * * * *